US005307133A

United States Patent [19]

Koshimizu et al.

[11] Patent Number: 5,307,133

[45] Date of Patent: Apr. 26, 1994

[54] IMAGE FIXING APPARATUS WITH MEANS FOR PREVENTING MOISTURE DEW ON FILM

[75] Inventors: Yoshiyuki Koshimizu, Abiko; Tsunetoshi Nagata, Yokohama; Masamutsu Azuma, Tokyo, all of Japan

[73] Assignee: Canon Kabushiki Kaisha, Tokyo, Japan

[21] Appl. No.: 547,246

[22] Filed: Jul. 3, 1990

[30] Foreign Application Priority Data

| | | | |
|---|---|---|---|
| Jul. 7, 1989 | [JP] | Japan | 1-176618 |
| Feb. 6, 1990 | [JP] | Japan | 2-027654 |
| Feb. 9, 1990 | [JP] | Japan | 2-030647 |

[51] Int. Cl.[5] ..... G03G 15/20

[52] U.S. Cl. ..... 355/285; 219/216; 355/282

[58] Field of Search ..... 355/282, 285, 290, 295, 355/284; 219/216; 250/316.1, 317.1, 318, 319; 430/98-100, 124; 432/59, 60

[56] References Cited

U.S. PATENT DOCUMENTS

| | | | |
|---|---|---|---|
| 3,502,407 | 3/1970 | Granzow et al. | 355/285 |
| 3,810,735 | 5/1974 | Moser | 219/216 X |
| 3,811,828 | 5/1974 | Ohta et al. | 432/59 X |
| 4,092,099 | 5/1978 | Chiba et al. | 432/59 |
| 4,202,618 | 5/1980 | Waschk et al. | 219/216 X |
| 4,319,828 | 3/1982 | Komori et al. | 355/210 |
| 4,453,820 | 6/1984 | Suzuki | 219/216 X |
| 4,566,779 | 1/1986 | Coli et al. | 355/212 |
| 4,585,319 | 4/1986 | Okamoto et al. | 355/200 |
| 4,652,110 | 3/1987 | Sato et al. | 219/216 X |
| 4,711,549 | 12/1987 | Roodbeen | 432/60 X |
| 4,714,427 | 12/1987 | Tsuruoka et al. | 432/59 |
| 4,954,845 | 9/1990 | Yano et al. | 355/290 |
| 4,963,942 | 10/1990 | Aoki | 355/290 |
| 4,963,943 | 10/1990 | Tamary | 355/290 |

FOREIGN PATENT DOCUMENTS

| | | | |
|---|---|---|---|
| 0295901 | 12/1988 | European Pat. Off. | 355/285 |
| 0316010 | 5/1989 | European Pat. Off. . | |
| 0145628 | 12/1978 | Japan | 355/282 |
| 0018747 | 2/1979 | Japan | 355/285 |
| 0117253 | 9/1981 | Japan | 355/285 |
| 0197580 | 12/1982 | Japan | 355/282 |
| 0174867 | 10/1984 | Japan | 355/282 |
| 0054453 | 3/1989 | Japan | 355/285 |

OTHER PUBLICATIONS

Patent Abstracts of Japan, vol. 7, No. 278, (P-242) [1423], Dec. 10, 1983.

Patent Abstracts of Japan, vol. 10, No. 157, (P-464) [2213], Jun. 6, 1986.

Patent Abstracts of Japan, vol. 10, No. 215, (P-481) [2271], Jul. 26, 1986.

IBM Technical Disclosure Bulletin, vol. 21, No. 7, Dec., 1978, p. 2985, New York, U.S.A.

*Primary Examiner*—A. T. Grimley

*Assistant Examiner*—William J. Royer

*Attorney, Agent, or Firm*—Fitzpatrick, Cella, Harper & Scinto

[57] ABSTRACT

An image fixing apparatus includes a heater which is fixed in operation; a film slidable relative to the heater and movable with a recording material, wherein a visualized image on the recording material is heated by heat from the heater through the film; and air discharging fan for discharging air around the film.

22 Claims, 11 Drawing Sheets

IMAGE FIXING APPARATUS WITH MEANS FOR PREVENTING MOISTURE DEW ON FILM

FIELD OF THE INVENTION AND RELATED ART

The present invention relates to an image fixing apparatus for heat-fixing a visualized image on a recording medium and also relates to an image forming apparatus such as a copying machine or a printer having the image fixing apparatus.

In a widely used conventional image fixing apparatus wherein the toner image is fixed on the recording material supporting an unfixed toner image, the recording material is passed through a nip formed between a heating roller maintained at a predetermined temperature and a pressing or back-up roller having an elastic layer and press-contacted to the heating roller. The heating roller type fixing apparatus requires that the temperature of the heating roller is maintained precisely at a predetermined level, and therefore, the heating roller is required to have a large thermal capacity. This necessitates a long waiting period until the surface of the heating roller reaches the operable temperature. This results in a larger consumption of electric power.

In order to solve this problem, U.S. Ser. Nos. 206,767, 387,970, 409,431, 416,539, 426,082, 435,427, 440,380, 440,678, 444,802, 446,449, 496,957, 502,223 proposes an image fixing apparatus having a fixed heater and a heat-resistive fixing film in a sliding contact with the heater, wherein the toner image is fused through the film.

However, it has been found that the image fixing apparatus having the fixed heater and the slidable film involves the following problems.

When the image fixing apparatus is operated continuously and repeatedly, a driving roller disposed downstream of the heater is heated to a significant extent. Particularly when the recording materials having a width significantly smaller than the heating width of the heater are continuously subjected to the fixing operation, the temperature rise of the driving roller is significant due to the temperature rise at the sheet-absent portion.

As regards the alignment between the heater and the sheet, there are two types, in one of which the center of the width of the sheet is aligned with the center of the heating width of the heater, and in the other of which a lateral side of the sheet is aligned with an end of the heater. If the latter is the case, the sheet-absent portion appears adjacent only one side with the result of temperature difference along the driving roller. In another case, the non-uniform driving roller temperature occurs because of the heat generating part or heat generating electrical parts contained in the image forming apparatus used with the image fixing apparatus.

When the non-uniform temperature distribution of the driving roller occurs, the diameter of the roller becomes different along the length of the roller due to the different thermal expansion of the driving roller. This is significantly influential to the lateral shifting of the fixing film, so that the fixing film is laterally shifted and is damaged despite the provision of some lateral shift preventing means. If the diameter of the roller is not uniform, the fixing film can be creased even to such an extent that the fixing film is torn.

Even when the diameter of the driving roller is not different along the length thereof, the increase of the driving roller diameter due to the thermal expansion results in change of the conveying speed of the fixing film, by which the conveying speed of the recording material is changed.

When the distance between the image transfer station and the image fixing nip is smaller than the length of the maximum usable recording material, there is a liability that the transferred image is disturbed. The experiments by the inventors have revealed that the diameter of a driving roller having a diameter of 20 mm and a rubber thickness of 1 mm, increases by approximately 0.04 mm, when the temperature rises by 25° C. This increase has been sufficient to disturb the balance of the lateral shifting force.

In the fixing apparatus using the fixed heater and the film, only the heating portion is at the high temperature, and the remainder is cool. It is particularly so, upon the initial fixing operation after the main switch is actuated. In the heat-fixing, the water contained in the paper is evaporated by the fixing heat, and the resultant vapor fills inside of the fixing apparatus. If there is a cool part, the vapor is condensed thereon. If the vapor is condensed on the film, or if the vapor is condensed on another part and is grown up to a droplet of water, which falls on the recording medium or the film, the fixed image involves a contamination by the droplet. When the film is driven by the roller, the roller is cool immediately after the start of the operation of the fixing apparatus. Therefore, the film tends to be cooled and to condense the vapor.

Where the film is in the form of an endless belt and where the fixing apparatus is equipped with a lateral shift control mechanism for controlling the lateral shifting of the film, the friction coefficient between the roller and the heat resistive endless film is changed by deposition of the water to the roller and/or the endless film. This results in the disturbance to the lateral balance of the endless film, so that the film is laterally shifted to one of the lateral sides. If this occurs, the proper image fixing operation is not possible.

Where a pressing rotatable member such as a pressing roller is used in order to urge the film and the recording material to the heater, the pressing rotatable member in some cases slips with the result of non-uniform image fixed.

SUMMARY OF THE INVENTION

Accordingly, it is a principal object of the present invention to provide an image fixing apparatus wherein a diameter of a driving roller for driving a film due to the temperature change of the driving roller is effectively prevented.

It is another object of the present invention to provide an image fixing apparatus wherein vapor is not condensed on the film.

It is a further object of the present invention to provide an image fixing apparatus wherein vapor is not condensed on a pressing rotatable member.

It is a further object of the present invention to provide an image fixing apparatus equipped with air discharging means for discharging the air around the film.

It is a further object of the present invention to provide an image fixing apparatus equipped with a fan for supplying dry air into the apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings.

Figure 2:
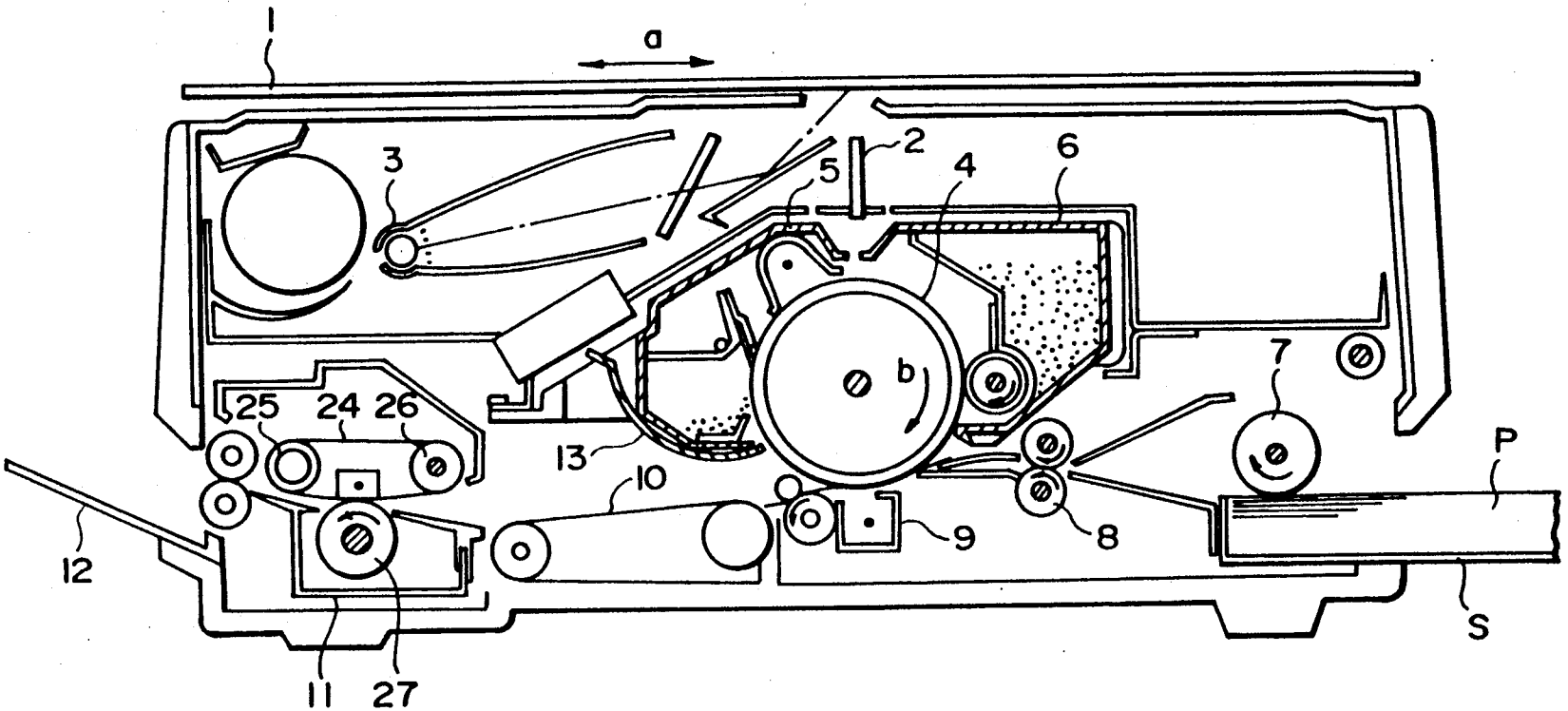
FIG. 2 is a sectional view of an image forming apparatus using the fixing apparatus of FIG. 1.

Referring first to FIG. 2, there is shown an image forming apparatus according to an embodiment of the present invention. As shown in this Figure, the apparatus comprises an original supporting platen made of transparent material such as glass, the platen being reciprocable in the direction indicated by an arrow a to scan an original placed thereon. Right below the original supporting platen 1, there is disposed an array 2 of imaging elements having a small diameter and short focus. The original placed on the platen 1 is illuminated by an illumination lamp 3, and the reflected light image therefrom is imaged on the photosensitive drum 4 through a slit by the array 2 of the imaging elements The photosensitive drum 4 is rotatable in the direction indicated by an arrow b. The apparatus further comprises a charger to uniformly charge the photosensitive drum 4 which is coated with a photosensitive layer made of zinc oxide or an organic photoconductive material. The photosensitive drum 4 uniformly charged by the charger 5 is exposed to image light through the array 2, so that an electrostatic latent image is formed. The electrostatic latent image is visualized with powdery toner comprising heat fusible or softening resin or the like by a developing device 6. A recording material (sheet) P accommodated in the cassette S is fed toward the photosensitive drum 1 by a pick-up roller 7 and a pair of conveying rollers 8 press-contacted to each other vertically. The conveying rollers function to feed the recording material P in timed relation with the image on the photosensitive drum 4. The toner image is transferred onto the recording material P by a transfer discharger 9. Thereafter, the recording material P is separated from the photosensitive drum 4 by known separating means and is transported to an image fixing apparatus 11 along a conveyance guide 10. In the fixing apparatus 11, the recording material P is subjected to the heating and image fixing operation, and thereafter is discharged to the tray 12. After the toner image is transferred from the photosensitive drum, the residual toner on the photosensitive drum 4 is removed by a cleaner 13.

Figure 3:
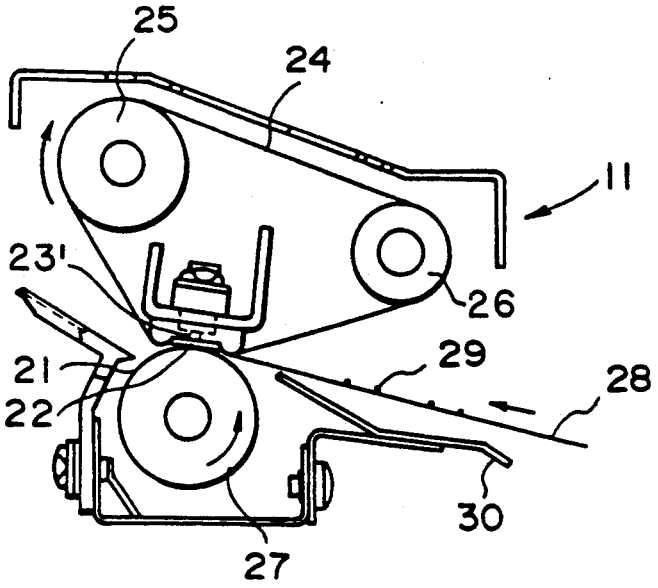
FIG. 3 is an enlarged sectional view of the fixing apparatus of FIG. 1.

FIG. 3 is an enlarged view of an image fixing apparatus 11 of FIG. 2. As shown in FIG. 3, the fixing apparatus comprises a rectilinear heating element having a low thermal capacity fixedly mounted on the apparatus. The element is made of electric resistor material 22 and is formed on an alumina substrate 21 having a thickness of 1.0 mm, a width of 10 mm and a length of 240 mm. The resistor material 22 is applied on the substrate 21 with a width of 1.0 mm. The resistor material 22 extends in a direction substantially perpendicular to the movement direction of the recording material. The heating element is connected with a voltage source at its opposite longitudinal ends. The power supply thereto is in the form of a pulse wave of DC 100 V having a frequency of 20 msec. The pulse width is changed in accordance with a temperature detected by a temperature sensor 23' and in accordance with a quantity of energy radiation. The pulse width ranges from 0.5– 5 msec approximately.

The fixing film 24 moves in the direction of the arrow in contact with the low thermal capacity linear heater 20 having the controlled temperature. An example of the image fixing film 24 is a heat-resistive film having a thickness of 20 microns made of polyimide, polyether imide, PES or PFA, coated at least at its side contactable with the image with a parting layer having a thickness of 10 microns, the parting layer being made of fluorinated resin such as PTFE or PFA added with conductive material. The film may be in the form of an endless film. Since the thermal capacity of the film increases with its thickness, the total thickness thereof is preferably not more than 100 microns, particularly not more than 40 microns from the standpoint of permitting quick start of the operation. The arrangement of the image fixing apparatus is such that the toner temperature is higher than the glass transition point, preferably higher than the toner softening point (ball and ring method), at the point where the recording material is separated from the film 24.

The film is driven by the driving roller 25 and a follower roller 26, around which the film is stretched, in the direction of the arrow.

A pressing roller 27 has a rubber elastic layer made of rubber material having good parting property such as silicone rubber. It is rotationally urged toward the heater 20 with the total pressure of 4–7 kg with the fixing film 24 sandwiched therebetween.

The unfixed toner 29 on the recording material 28 is introduced into the image fixing apparatus along an inlet guide plate 30, and is heated and fixed. There is no air layer between the heat generating resistor layer and the visualized image.

The image forming apparatus usable with the image fixing apparatus according to this embodiment is usable with an electrophotographic copying machine shown in FIG. 2, an electrophotographic printer, an electrostatic recording apparatus or the like.

In the image fixing apparatus of this embodiment, the endless film 24 laterally shifts, that is, shifts in a direction perpendicular to the movement direction thereof. Therefore, a mechanism for preventing the lateral shift is provided. In this embodiment, the lateral shift of the fixing film 24 is detected by an optical sensor, and the follower roller 26 is raised or lowered in response to the detection, by which the lateral shift of the fixing film 24 is maintained within a predetermined range.

Figure 4:
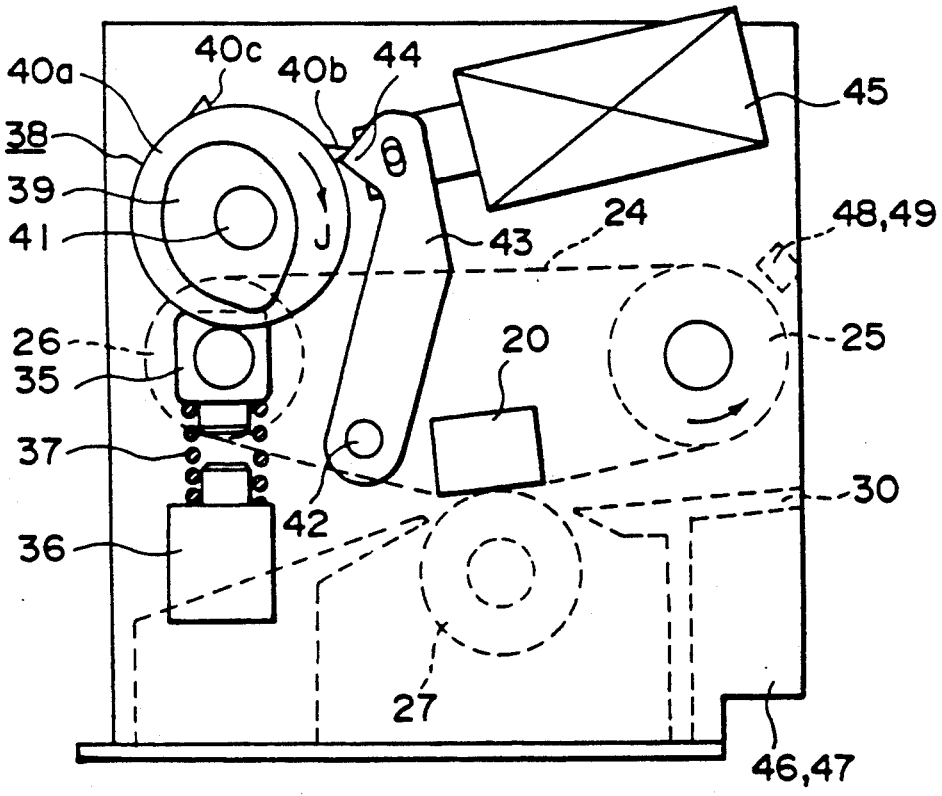
FIG. 4 is a sectional view illustrating one state of a film lateral shift preventing mechanism used in the apparatus of FIG. 3.
Figure 5:
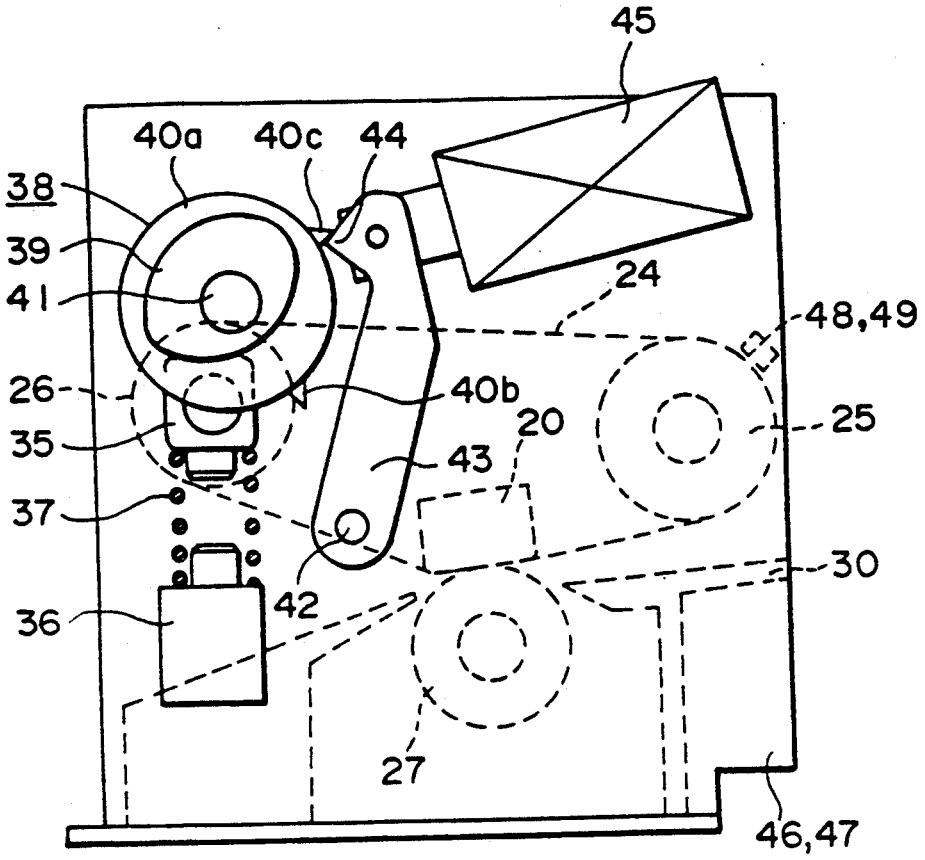
FIG. 5 is a sectional view similar to FIG. 4 but illustrating another state.

Referring to FIGS. 4 and 5, there is shown an example of a lateral shift preventing mechanism, as seen from the rear side of the fixing apparatus.

A bearing 35 of the follower roller 26 is supported by the side plate 46 for vertical sliding movement and rotatably supports an end of the follower roller 26. The other end of the follower roller 26 is rotatably supported by a bearing mounted on the side plate 47.

A fixing member 36 is mounted on the side plate 46 and supports an end of a spring 37 for upwardly urging the bearing 35, and the bottom portion of the bearing 35 is urged by the other end of the spring 37. A spring clutch 38 comprises an input hub (not shown), a coil spring (not shown) having a control pawl (not shown), a control collar 40*a* for holding the control pawl, and an output hub 41. When the control collar 40*a* is stopped by the engagement between an engaging pawl 40*b* or 40*c* with a pawl lever 44, as shown in FIGS. 4 and 5, the rotational force is not transmitted from the input hub to the output hub 41. When the pawl lever 44 is disengaged from the engaging pawl 40*b* or 40*c* , the control collar 40*a* becomes rotatable, so that the driving force is transmitted from the input hub to the output hub 41. The rotational driving force is transmitted at all times in the detection indicated by an arrow J through an unshown gear or gears to the input hub. To the output hub 41, a cam 39 is fixed for integral rotation, the cam 39 having a cam profile having a different radius at different angular position. As shown in FIG. 4 when the engaging pawl 40*b* and the pawl lever 44 are engaged, the radius at the bottom side of the cam 39 is maximum. When the engaging pawl 40*c* and the pawl lever 44 are engaged, as shown in FIG. 5, the radius at the bottom of the cam 39 is minimum between the maximum and minimum positions, the radius smoothly changes.

Therefore, when the engaging pawl 40*b* is engaged with the pawl lever 44, the maximum radius portion of the cam 39 lowers the bearing 35, whereas when the engaging pawl 40*c* is engaged with the pawl lever 44, the bearing 35 is raised upwardly by the spring 37.

The lever 43 is rotatably supported on a pin 42 planted in the side plate 46, and the other end thereof is formed into a pawl 44. Said other end is coupled with an operating rod of a solenoid 45. The solenoid 45 is energized for a predetermined period of time in response to the signals from the sensors 48 and 49.

The sensors 48 and 49 detect that the fixing film 24 shifts toward the rear and the front, respectively, beyond the predetermined limits. The output signals of the sensors 48 and 49 are transmitted to a microcomputer, which energizes and deenergizes the solenoid 45 under a predetermined sequence.

Figure 6:
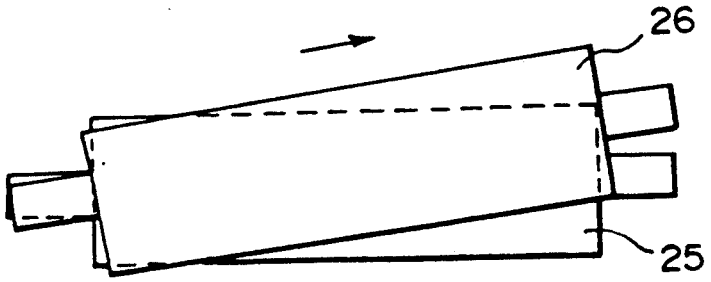
FIG. 6 illustrates movement of the fixing film by the mechanism shown in FIGS. 4 and 5.

FIG. 6 shows a positional relationship between the follower roller 26 and the driving roller 25, as seen from the sheet feeding side. As described hereinbefore, when the minimum radius portion of the cam 39 of FIG. 5 is opposed to the bearing 35, the end of the follower roller 26 is raised by the spring 37, so that the right side of the follower roller 26 is raised as shown in FIG. 6. Then, the fixing film 24 is forced to shift laterally toward the right side (rear side). When the bearing 35 is lowered by the cam 39 in the manner described in the foregoing, the fixing film 24 is forced to laterally shift toward the left side (front side).

By displacing the follower roller 26 through a cam mechanism or the like in response to output signals from the sensors 48 and 49, the fixing film 24 can travel stably within a predetermined region.

Figure 1:
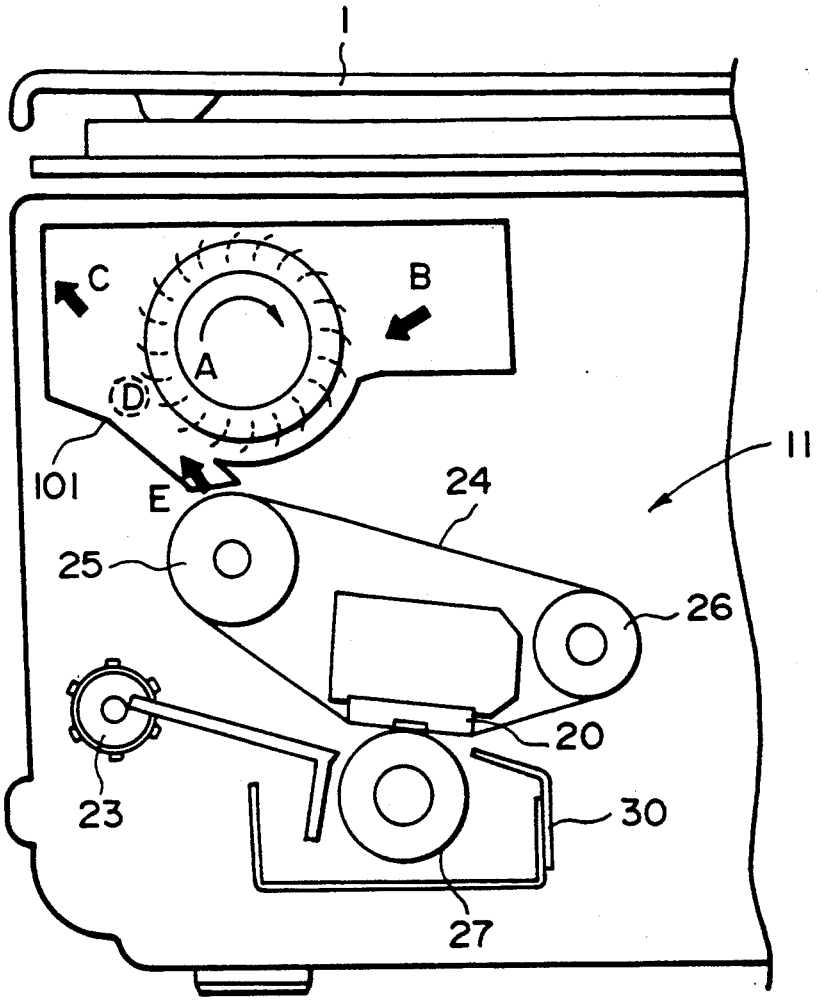
FIG. 1 is a sectional view of an image fixing apparatus according to an embodiment of the present invention.

Referring now to FIG. 1, an image forming apparatus according to an embodiment of the present invention is shown. The apparatus comprises, as shown in FIG. 1, a cross-flow fan 101 driven by a small size DC motor which is provided exclusively for the fan. The fan 101 rotates in the direction A to produce air flows in the directions B and C. As a result, a negative pressure is produced at a portion indicated by a reference D, so that the flow indicated by an arrow E is produced, by which the air is sucked from the neighborhood of the driving roller 25. Thus, the driving roller 25 is cooled.

The water vapor produced from the recording material is discharged to the outside of the apparatus by the air flow produced by the fan, so that the vapor is not condensed on the film 24.

Figure 7:
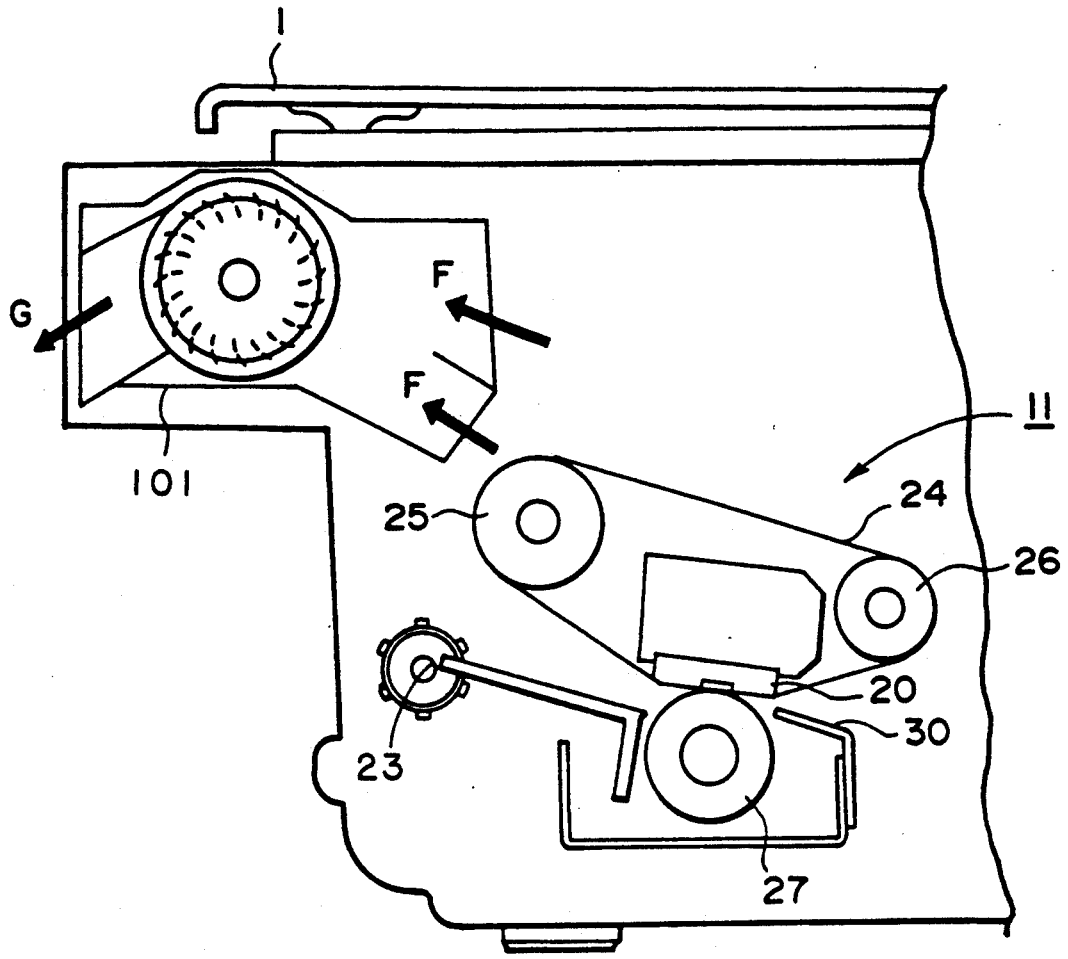
FIG. 7 is a sectional view of an image fixing apparatus according to a second embodiment of the present invention.

Referring to FIG. 7, there is shown an apparatus according to a second embodiment of the present invention. This embodiment is suitable when the main assembly of the image forming apparatus has sufficient space. The air flows F and G are produced adjacent the driving roller 25 at the inlet side of the cross-flow fan 101.

In the FIGS. 1 and 7 embodiments, the crossflow fan 101 may be used also to prevent the temperature rise at the other part or parts of the image forming apparatus such as a main motor or a heat generating electrical parts, and/or to discharge the ozone produced by the process unit to the outside of the apparatus.

In the image fixing apparatus 11 of the embodiments, the fixing film 24 may be cooled, as contrasted to a heating roller in a heating roller type image fixing apparatus. The reason for this is that the toner image on the recording material is rapidly fixed by the heat and pressure provided by the nip, and therefore, the fixing performance and the prevention of the toner offset are not dependent on the temperature of the fixing film 24 outside the nip. In addition, the power consumption is not increased even if the film 24 is cooled.

Figure 8:
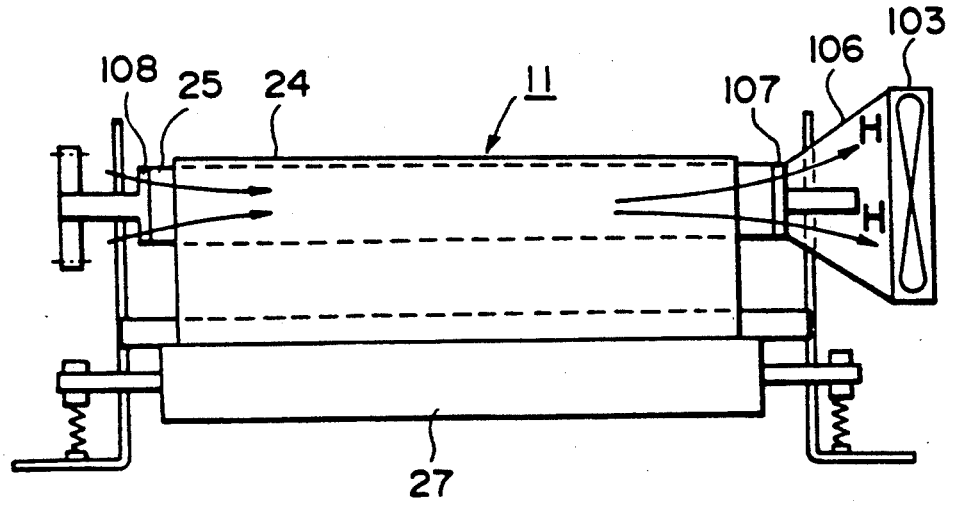
FIG. 8 is a rear view of the apparatus of FIG. 3.

FIG. 8 shows a third embodiment of the present invention. FIG. 8 is a rear view of the fixing apparatus 11, as seen from the sheet discharge side. In FIG. 8, designated by a reference numeral 103 is an axial-flow type small size fan and is driven by a small size DC motor or the like exclusively for the fan. It produces air flow in the direction indicated by an arrow H. The driving roller 25 includes a pipe coated with a silicone rubber layer (sintered) to increase the friction with the fixing film 24. The longitudinal opposite ends of the driving roller 25 are provided with flanges 107 and 108 having openings to permit air flow. The flanges 107 and 108 are supported by the respective bearings. When the fan 103 rotates, the air flow is produced in the driving roller 25 in the direction indicated by the arrows, thus preventing the temperature rise of the driving roller 25. In order to increase the cooling efficiency, a hood 106 is provided to connect the fan 103 and the driving roller 25. In order to further enhance the heat radiation and cooling effects, a fan may be disposed inside the driving roller 25.

The fan 103 may be rotated by the driving source for the driving roller 25 in place of the dedicated driving source.

The cooling effect of the driving roller is enhanced by the air flow through the driving roller, but the air flow does not function to prevent the condensing of the vapor produced from the recording material, and therefore, the first and second embodiments are preferable from the standpoint of preventing the water vapor from condensing.

Figure 9:
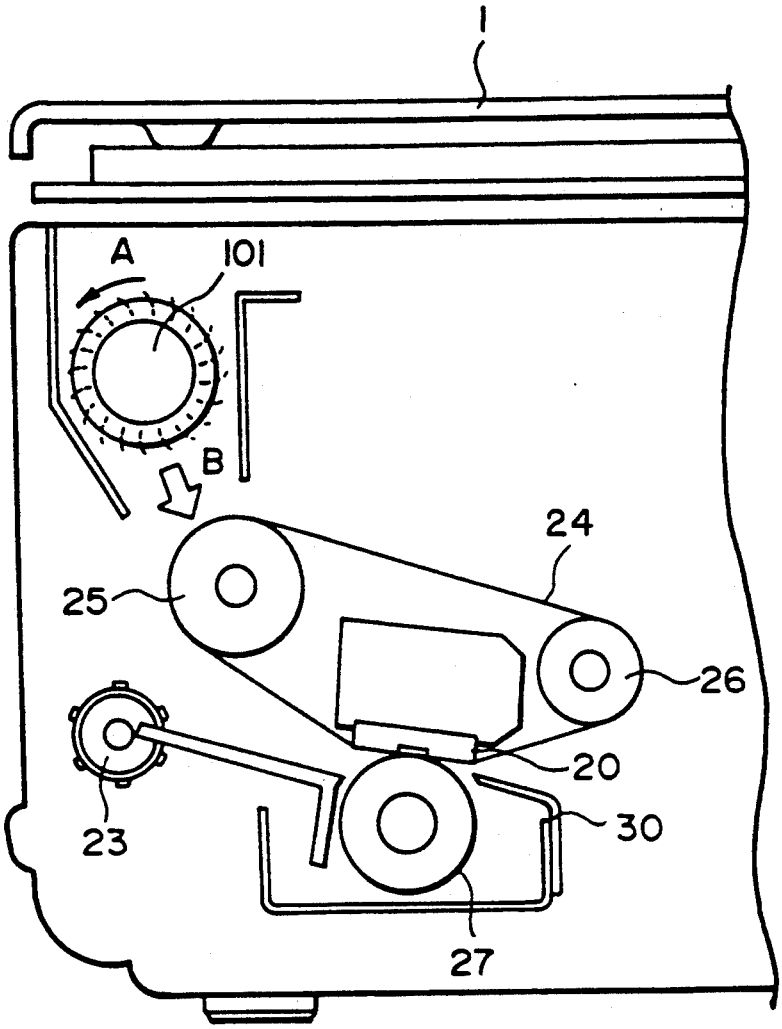
FIG. 9 is a sectional view of an image fixing apparatus according to a further embodiment of the present invention.

FIG. 9 illustrates a fourth embodiment of the present invention in an enlarged scale. A guide plate 30 for guiding the sheet functions to correctly direct the sheet to the fixing station. Designated by a reference numeral 23 is a sheet discharging roller. A cross-flow fan 101 is driven by a dedicated small size motor.

In operation, an unshown main switches actuated, and a copy button is depressed, upon which an image formation signal is produced. Then, the electric power is supplied to the heat generating resistor 16 and to the illumination lamp 3. Simultaneously therewith, the cross-flow fan 101 starts it rotation in the direction A to produce the air flow in the direction B, by which the air which has cooled the image forming station (more particularly, the original illumination lamp in this embodiment), and therefore, which is dried and has a high temperature, is supplied to the neighborhood of the driving roller 25. By doing this, the water vapor is prevented from condensing on the neighborhood of the driving roller 25.

When the high temperature air is supplied as in this case, the cooling effect for the driving roller slightly lowers, but it is practically no problem, and the effect of the prevention of the water vapor condensation is significantly enhanced, which is much better.

Figure 10:
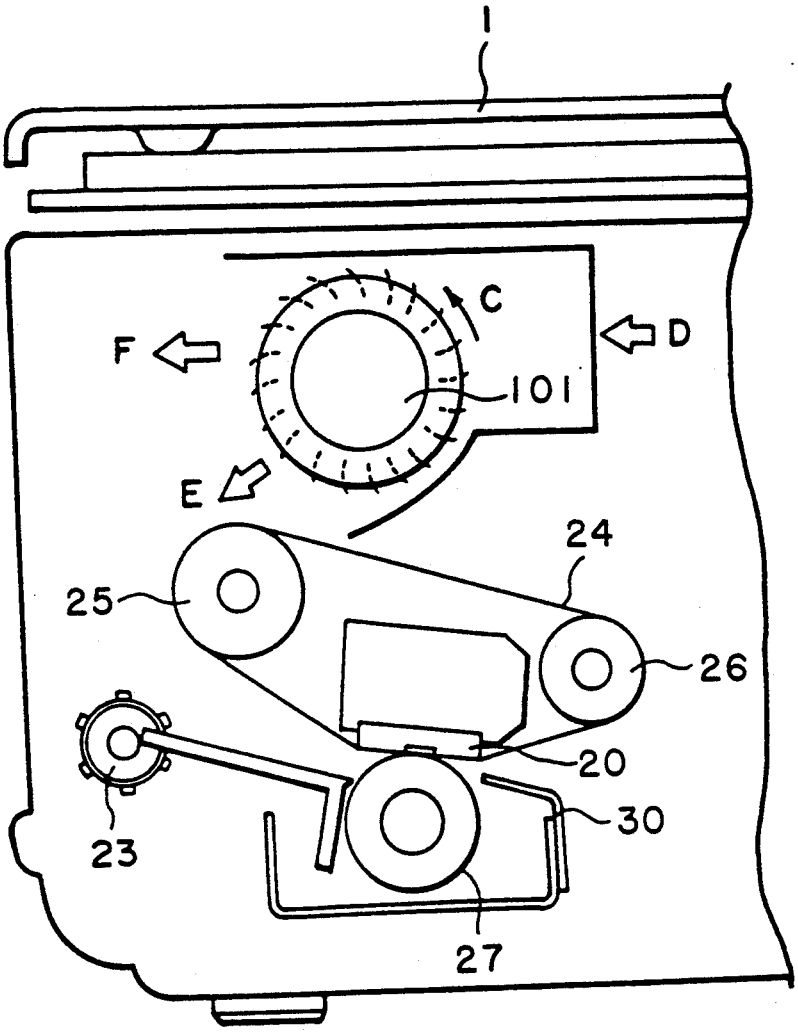
FIGS. 10 and 11 are enlarged sectional views of the image fixing apparatuses according to further embodiment of the present invention.

FIG. 10 shows a further embodiment. In this embodiment, the discharging opening of the cooling fan 101 of the main assembly is enlarged to supply the air to the neighborhood of the driving roller 25. The fan rotates in the direction C to suck the air in the direction D to supply the air in the directions E and F, thus evaporating the water condensed on the neighborhood of the driving roller 25. In this embodiment, the fan 101 also functions to cool the main assembly, to discharge the ozone to the outside of the apparatus and to evaporate the condensed water. Therefore, the cost and the size can be reduced.

Figure 11:
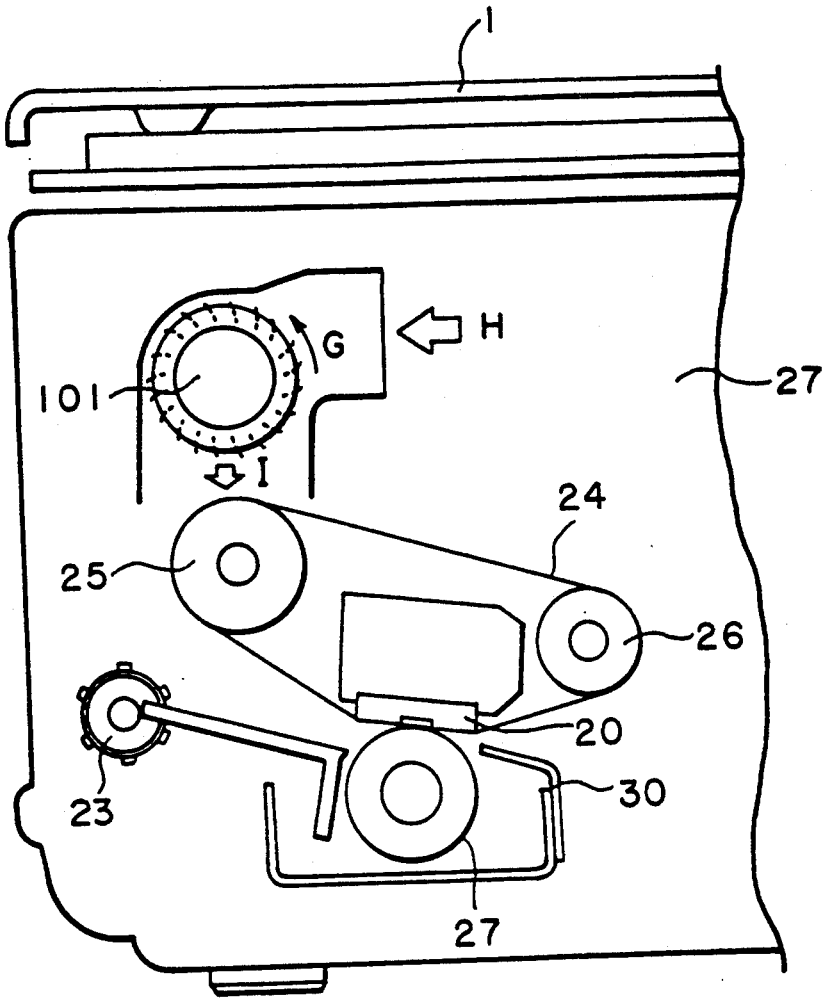

FIG. 11 shows a further embodiment wherein a cross-flow fan 101 sucks the high temperature air adjacent the lamp 3 in an unshown optical system in the direction H, and the fan 101 rotates in the direction G to discharge the air in the direction I. By this arrangement, the dried high temperature air is supplied to the neighborhood of the driving roller 25, and therefore, the condensed air around the fixing apparatus can be evaporated. As an alternative, the high temperature air adjacent to the power source, the heat generating electrically parts, the motor or the like in place of the lamp of the optical system may be sucked.

Figure 12:
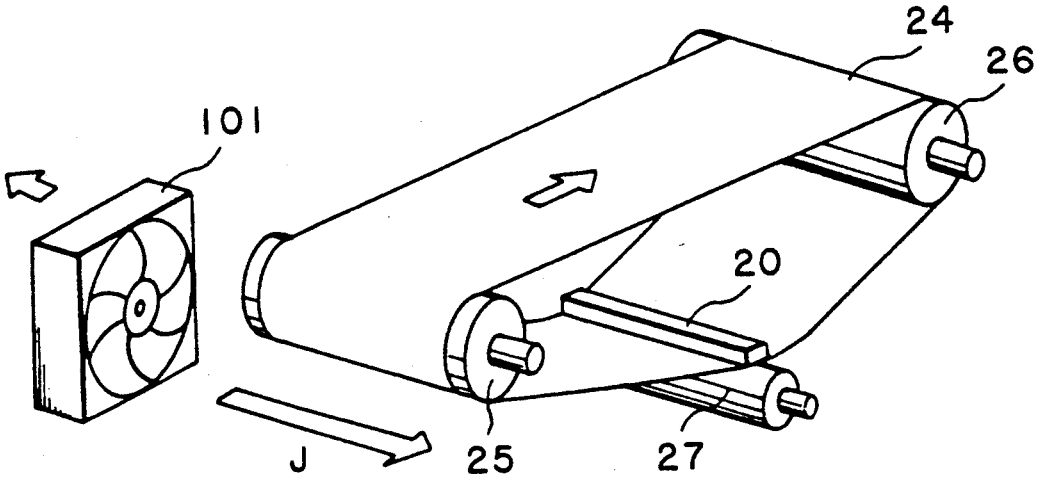
FIG. 12 is a perspective view of an image fixing apparatus according to a yet further embodiment of the present invention.

FIG. 12 is a perspective view of a yet further embodiment. In this embodiment, a motor fan 27 supplies air in the direction J, that is, in the longitudinal direction of the driving roller 25, by which the condensed air is evaporated.

Figure 13:
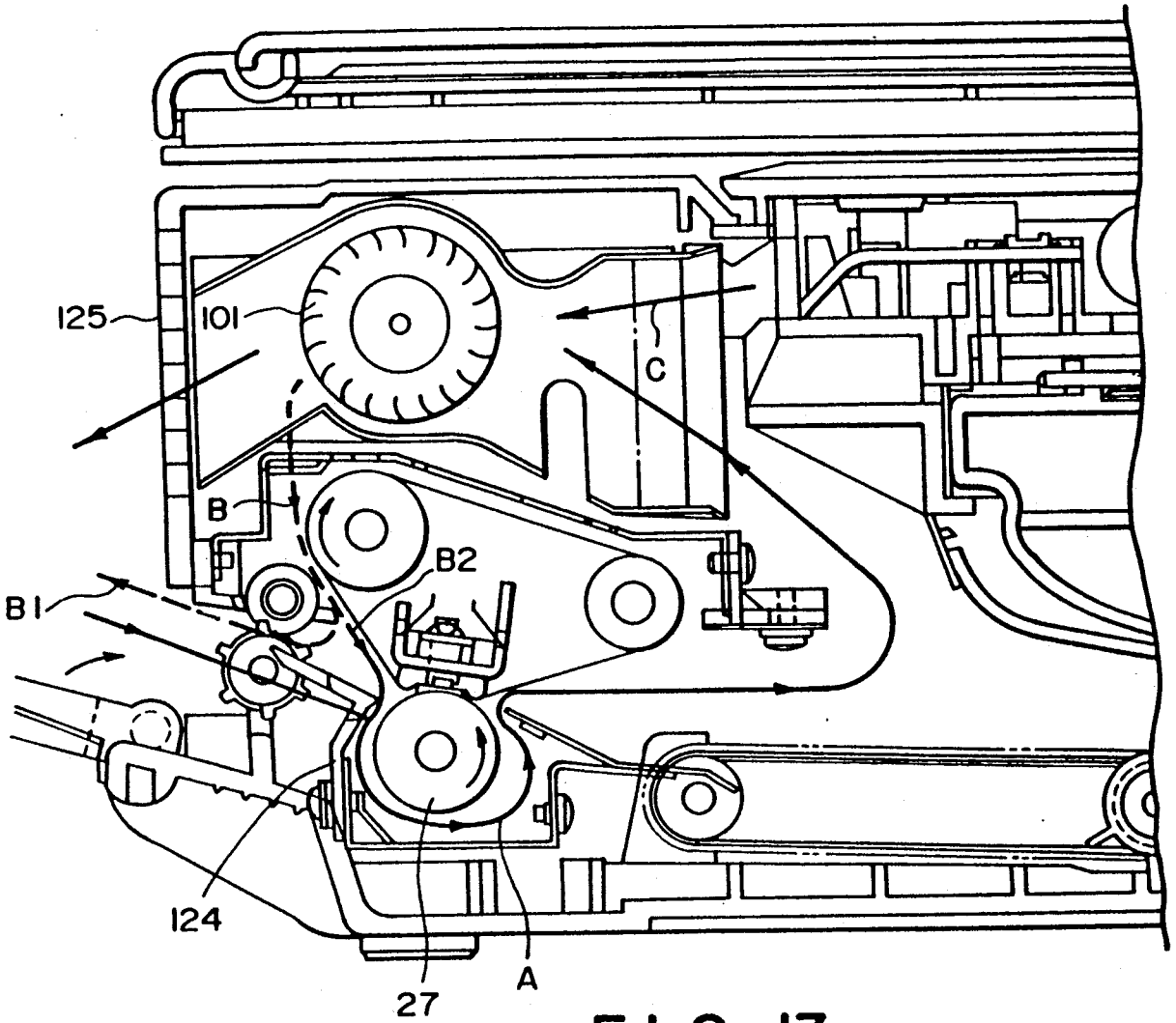
FIG. 13 is a sectional view of a major part of an image fixing apparatus according to a further embodiment of the present invention.

FIG. 13 shows a further preferable embodiment, wherein a separation guide member 124 for guiding the recording material after the image fixing operation is provided with an opening 124*a* to permit air flow therethrough. Then, an air flow passage indicated by a solid line arrow A is formed adjacent the pressing roller 27 by the sucking force of the fan 101. More particularly, the air flow passage extends from an outside of the image forming apparatus through the opening of the guide member 124 and by way of the periphery of the pressing roller to an outside of the image forming apparatus.

With this arrangement, even if the water vapor produced from the recording material after the image fixing operation comes to the neighborhood of the pressing roller 27 when the pressing roller 27 has a low temperature, the air flow provided by the sucking force of the fan 101 along the solid line arrow A is effective to discharge out through a louver of an outer casing 125 the water vapor adjacent to the pressing roller 27. Therefore, even if the water vapor comes to the neighborhood of the low temperature pressing roller 27, the vapor does not stagnate adjacent the pressing roller 27, so that the vapor is prevented from being condensed on the pressing roller.

Figure 14B:
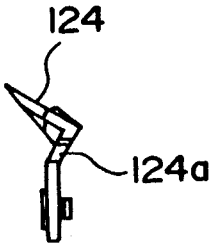
FIGS. 14A and 14B are front view and a sectional view illustrating a separation guide member.
Figure 14A:
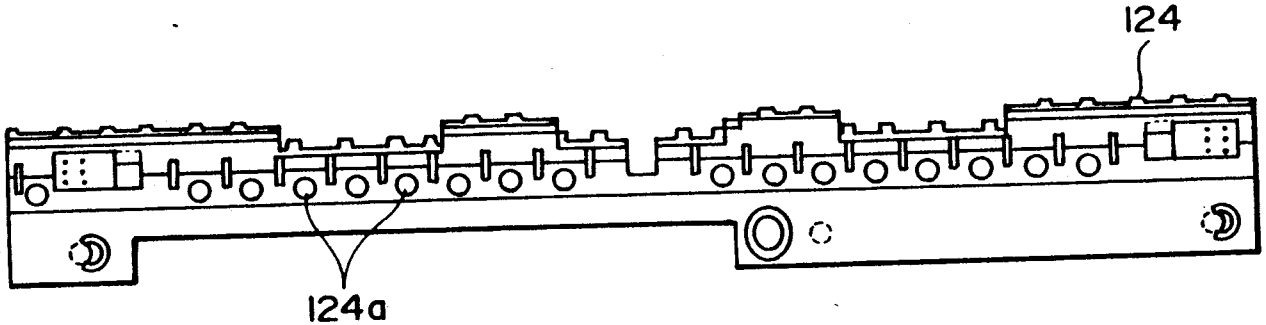

FIGS. 14A and 14B show an example of a separation guide member having the opening 124*a*.

In addition, since there is an additional air flow passage as indicated by a broken line arrow B from the fan 101, the water vapor produced from the recording material is not supplied to the neighborhood of the endless film 24 but is discharged out of the apparatus, by which the deposition of the water droplets on the endless film 24 is prevented.

In this embodiment, the air flow passage indicated by an arrow B is branched downwardly as indicated by a broken line. The branched passage is further branched to a passage B1 extending to the outside of the image forming apparatus and to a passage B2 merging into the passage A by way of the periphery of the pressing roller 27. Particularly in this embodiment, an air flow passage indicated by a solid line C is formed to take up the air heated and dried by an unshown original illumination lamp or the like. Accordingly, it is further advantageous from the standpoint of preventing the water vapor from condensing on the pressing roller to provide in the air flow passage B2 extending from the passage B to the passage A by way of the periphery of the pressing roller 27.

The fan may be driven by a known driving system.

Figure 15:
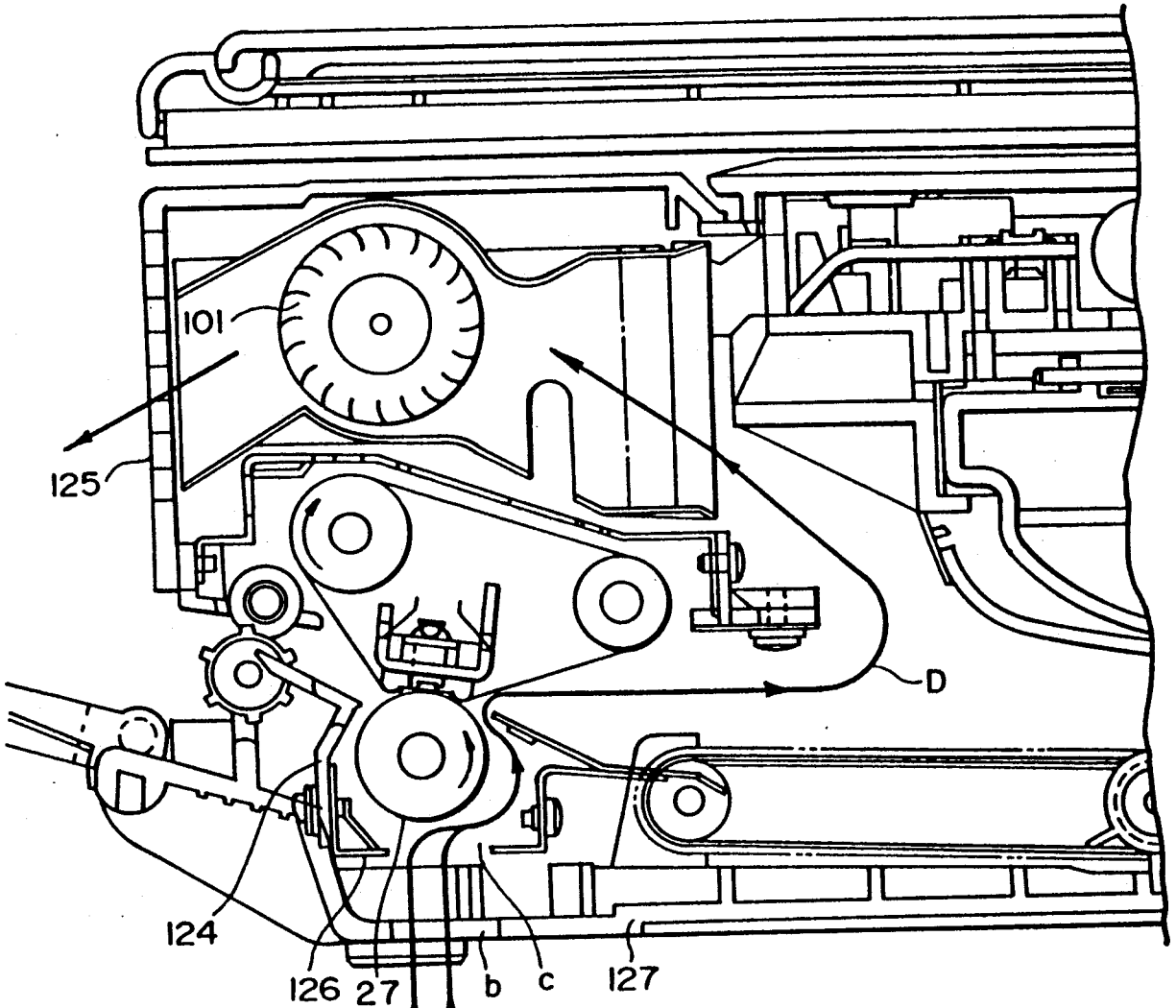
FIG. 15 is a sectional view of a major part of the image fixing apparatus according to a yet further embodiment of the present invention.

FIG. 15 shows a further embodiment, in which a bottom plate 127 of the image forming apparatus and a bottom stay 126 of the image fixing apparatus are provided with openings B and C, respectively at the positions corresponding to the pressing roller 27. By the formation of the openings, an air passage indicated by an arrow D is established in the neighborhood of the pressing roller 27 by the sucking force of the fan 101. Therefore, even if the water vapor produced from the recording material after the image fixing operation comes to the neighborhood of the pressing roller 27 when the pressing roller 27 has a low temperature, the water vapor is discharged to the outside of the apparatus because there is the air flow along the solid line D in FIG. 15. Accordingly, the water vapor is prevented from condensing on the pressing roller as water droplets.

As described in the foregoing, the air flow passages are established not only around the film but also around the pressing roller, and therefore, the condensation of the water vapor on the film and the pressing roller can be effectively prevented to accomplish stabilized image fixing operation.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a heater;

an endless film contacted to said heater and movable with a recording material, wherein a visualized image on the recording material is heated by heat from said heater through said film;

a driving rotatable member for driving said film, said member located separate from said heater; and cooling means for cooling said driving rotatable member.

2. An apparatus according to claim 1, wherein said heater is fixed in operation and said film is slidable relative to said heater.

3. An apparatus according to claim 1, wherein said heater extends in a direction substantially perpendicular to a movement direction of said film, and wherein said cooling means includes a cross-flow fan extending along a length of said heater.

4. An apparatus according to claim 1, wherein said cooling means includes a discharging fan for discharging the air downstream of said heater with respect to a movement direction of the recording material.

5. An apparatus according to claim 1, wherein said film is in the form of an endless belt.

6. An apparatus according to claim 1, wherein the visualized image is a powdery toner image not fixed.

7. An apparatus according to claim 1, wherein said heater has a heat generating resistor layer extending in a direction substantially perpendicular to a movement direction of the recording material and generating heat upon electric power supply thereto.

8. An apparatus according to claim 7, wherein there is no air layer between said heat generating resistor layer and the visualized image.

9. An image forming apparatus, comprising:

image forming means for forming a visualized image on a recording material;

a heater;

an endless film contacted to said heater and movable with the recording material, wherein the visualized image on the recording material is heated by heat from said heater through said film; and air supply means for supplying air having cooled said image forming apparatus to said film, wherein said heater has a heat generating resistor layer extending in a direction substantially perpendicular to a movement direction of the recording material and generating heat upon electric power supply thereto.

10. An apparatus according to claim 9, wherein said image forming apparatus includes an illumination system for illuminating an original, and wherein said air supply means supplies air having cooled said illumination system.

11. An apparatus according to claim 9, wherein said heater extended in a direction substantially perpendicular to a movement direction of said film, and wherein said air supply means includes a cross-flow fan extending in a longitudinal direction of said heater.

12. An apparatus according to claim 9, wherein said air supply means supplies the air to an area downstream of said heater with respect to a movement direction of the recording material.

13. An apparatus according to claim 9, wherein said heater is fixed in operation and said film is slidable relative to said heater.

14. An apparatus according to claim 13, wherein said film is in the form of an endless belt.

15. An apparatus according to claim 9, wherein there is no air layer between said heat generating resistor layer and the visualized image.

16. An image fixing apparatus, comprising:

a heater which is fixed during an image fixing operation;

a film slidable relative to said heater and movable together with and in cross contact with a recording material, wherein a toner image on the recording material is heated and fused by heat from said heater through said film;

a pressing rotatable member for urging the recording material and said film toward said heater;

wherein said film and the recording material are separated from each other when the toner has a temperature higher than a glass transition point of the toner; and air flow means for providing an air flow passage extending from a neighborhood of said pressing rotatable member to an outside of said apparatus.

17. An apparatus according to claim 16, wherein said air flow means provides an air flow passage adjacent said film.

18. An apparatus according to claim 16, wherein around said pressing rotatable member, air flows in the same direction as rotation of said pressing rotatable member.

19. An apparatus according to claim 16, wherein said heater extends in a direction substantially perpendicular to a movement direction of said film, and wherein said air flow means includes a cross-flow fan extending in a longitudinal direction of said heater.

20. An apparatus according to claim 16, wherein said film is in the form of an endless belt.

21. An apparatus according to claim 16, wherein said heater has a heat generating resistor layer extending in a direction substantially perpendicular to a movement direction of the recording material and generating heat upon electric power supply thereto.

22. An apparatus according to claim 21, wherein there is no air layer between said heat generating resistor layer and the visualized image.

* * * * *

UNITED STATES PATENT AND TRADEMARK OFFICE

CERTIFICATE OF CORRECTION

PATENT NO. : 5,307,133

DATED : April 26, 1994

INVENTOR(S) : Yoshiyuki Koshimizu et al

It is certified that error appears in the above-indentified patent and that said Letters Patent is hereby corrected as shown below:

Column 1, line 38, "Particularly" should read —Particularly,—

Column 3, line 58, "elements" should read —elements.

Column 7, line 28, "it" should read —its—; and
line 64, "cally" should read —cal—.

Signed and Sealed this

Fourth Day of October, 1994

Bruce Lehman

*Attest:*

BRUCE LEHMAN

*Attesting Officer*

*Commissioner of Patents and Trademarks*